US011439860B2

(12) United States Patent
Lind et al.

(10) Patent No.: US 11,439,860 B2
(45) Date of Patent: Sep. 13, 2022

(54) EXERCISE APPARATUS

(71) Applicants: Daniel Stephen Lind, Chorley Lancashinre (GB); Gareth William Thomas, Eaglescliffe Stockton-on Tees (GB)

(72) Inventors: Daniel Stephen Lind, Chorley Lancashinre (GB); Gareth William Thomas, Eaglescliffe Stockton-on Tees (GB)

( * ) Notice: Subject to any disclaimer, the term of this patent is extended or adjusted under 35 U.S.C. 154(b) by 232 days.

(21) Appl. No.: 16/993,508

(22) Filed: Aug. 14, 2020

(65) Prior Publication Data

US 2021/0387037 A1 Dec. 16, 2021

(51) Int. Cl.
*A63B 21/00* (2006.01)

(52) U.S. Cl.
CPC .... *A63B 21/0004* (2013.01); *A63B 21/00185* (2013.01); *A63B 21/4035* (2015.10); *A63B 21/4039* (2015.10); *A63B 21/4049* (2015.10); *A63B 2209/00* (2013.01)

(58) Field of Classification Search
CPC ..... A63B 21/0004; A63B 21/00185; A63B 21/4035; A63B 21/4039; A63B 21/4049; A63B 23/03541; A63B 23/12; A63B 23/14; A63B 2209/00
See application file for complete search history.

(56) References Cited

U.S. PATENT DOCUMENTS

| | | | | |
|---|---|---|---|---|
| 5,125,878 | A * | 6/1992 | Wingate | A63B 23/16 482/121 |
| 5,611,755 | A * | 3/1997 | Blackmore | A63B 23/16 482/44 |
| 8,256,031 | B2 * | 9/2012 | Von Kahle | B62J 27/00 280/288.4 |
| 10,449,404 | B2 * | 10/2019 | Wood | A63B 23/0205 |
| D885,499 | S * | 5/2020 | Sutton | D21/680 |
| 2005/0187079 | A1 * | 8/2005 | Diakonov | A63B 21/075 482/106 |
| 2010/0069206 | A1 * | 3/2010 | Viselman | A63B 21/0602 482/106 |
| 2013/0337977 | A1 * | 12/2013 | Kokenis | A63B 21/15 482/110 |

* cited by examiner

*Primary Examiner* — Joshua Lee

(57) ABSTRACT

A portable exercise apparatus in the shape of a square having a handle at either side, which handles are arranged rotatable on spindles such that the user can impart movement on said apparatus without changing his/her grip.

8 Claims, 3 Drawing Sheets

EXERCISE APPARATUS

PRIORITY

This application claims priority to GB No. 2008827.4 filed 10 Jun. 2020.

FIELD OF THE INVENTION

The invention relates to exercise apparatus and more particularly to hand-held exercise apparatus.

BACKGROUND OF THE INVENTION

There is a veritable myriad of exercise apparatus of all shapes and sizes. The vast majorities of them are large, cumbersome and take up a lot of space.

In modern living most people's homes are not of sufficient size for such machinery to be installed without sooner or later getting in the way of ordinary living.

The inventors have taken this to heart and designed an exercise apparatus which is small, lightweight and fits into the average satchel. It has no clumsy moving parts nor does it need maintenance.

It is virtually indestructible and can be used in the smallest of places. It is molded in glass filled nylon and the handles are made from thermoplastic elastomers. The main body is rigid and the handles are elastic to the grip, to improve grip-strength.

The inventive apparatus is compact, it measures 180 mm by 180 mm and has a thickness of 35 mm. Naturally, there will be larger versions available for people with extra-large hands. These versions may be up to 250 mm square and fractionally thicker.

However, the dimensions cited here above, do not form part of the invention and are only mentioned for illustrative purposes. Neither should the drawings to be used to determine anything other than the general appearance of the apparatus.

The apparatus is designed to strengthen upper body muscles such as biceps, triceps, shoulders and forearms. Chest and neck muscles are also addressed in these exercises through easy routines.

The apparatus comprises essentially a square, consisting of three vertical and two horizontal struts. The terms vertical and horizontal refer to their orientation when the apparatus is held ready for use.

The two outer vertical struts are covered with a rotatable sleeve each. These sleeves are molded from a thermoplastic elastomer, providing the user with a comfortable feeling of softness on their outside, but still keeping shape as to not interfere with the rotatable nature of the grip.

The horizontal struts are connecting pieces, holding the three vertical struts in a rigidly fixed position relative to each other. They are hollow to save material and to make the whole apparatus lighter but still rigid.

The main body is molded in two parts to be fitted together after the handles are slipped over the halve struts, also referred to as spindles.

The outer struts comprise fittings which allow precise connections between the two halves of the apparatus. The central strut is hollow and provides for a connecting screw to be slid in from above or below which is secured by a threaded nut at its open end.

The apparatus is meant to be used by being held in both hands, one outer strut in each hand. The exercises are simple but very effective.

As an example, one exercise could consist of holding the apparatus as described above, the user moves one hand away from his/her body and simultaneously pulls the other hand towards the body, in a sort of push-pull motion.

The rotating handles allow that to be done without the user needing to change grip, hence keeping a firm concentrated pressure, thus exercising upper arm and shoulder muscles.

These movements can be accompanied by a twisting motion thus also achieving lower arm exercises.

In this way, upper-body exercises may be performed in a relatively small area without any cumbersome piece of machinery which would clutter up space in a house or gymnasium, where other things may also need to be done.

STATEMENT OF THE INVENTION

An exercise apparatus comprising a rigid hard plastic frame consisting of three first parallel struts, arranged orthogonally to two second struts, one at each end of said three first struts, all five struts being arranged in one and the same plane, whereby said two second struts connect said three first orthogonal struts to form a square and wherein the outer two first struts consist of a rigid spindle and an elastic sleeve, which sleeve rotates on said spindle, such that, when in use, said sleeves serve as hand holds by means of which the apparatus is to be held and manipulated.

BRIEF DESCRIPTION OF THE DRAWINGS

In the drawings, which illustrate a preferred embodiment of the invention.

DETAILED DESCRIPTION OF THE PREFERRED EMBODIMENT

Figure 1:
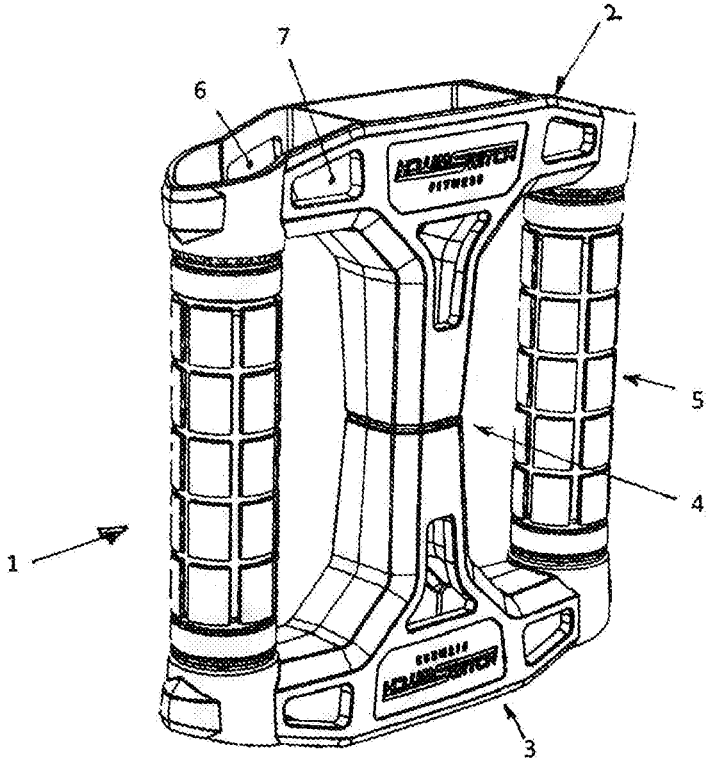
FIG. 1 shows the "switch fitness mate" apparatus in perspective view.

On the perspective view, FIG. 1, the whole apparatus (1) is shown. At (2) and (3) the top and bottom connecting struts are indicated. It can be seen clearly that they are hollow, with cut-outs for weight reduction on the top and front (6) and rear (7) and the same for the bottom one.

The centre strut is partially hollow. At the point where the two halves meet (4) is a more solid section on both halves of the apparatus, which only has a through hole wide enough for a connection screw (8) to pass through and connect to a threaded nut (9) to form a solid connection between the two parts. This is illustrated in more detail on FIG. 3.

Figure 2:
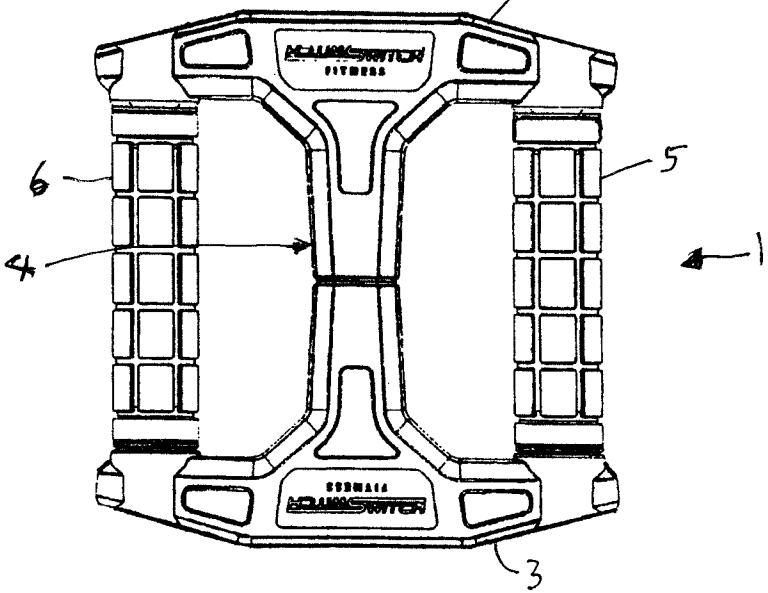
FIG. 2 shows the front elevation view of the apparatus.

FIG. 2 shows the apparatus in elevation, side view and top/bottom view. These views show clearly the cut-outs in the frame which ensure the weight of the whole apparatus remains relatively low.

The exercises are not meant to be influenced by the weight of the apparatus. The apparatus is designed to help shape the exercises and make them repeatable to a fine degree, thus ensuring the even and efficient training of the relevant muscles.

Figure 3:
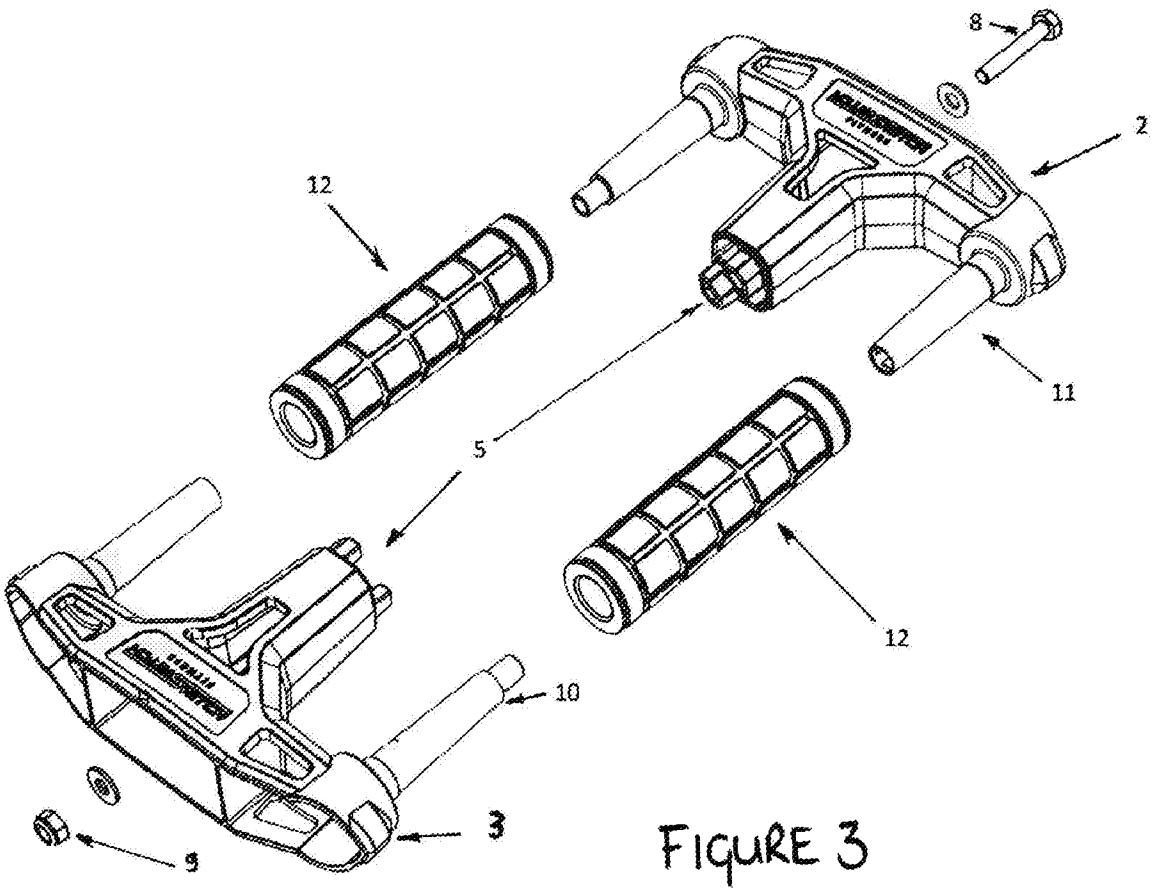
FIG. 3 shows an exploded view of the apparatus before assembly.

As stated above, FIG. 3 shows an exploded view of the apparatus before final assembly The two outer vertical struts (10) and (11) also come in two halves each. Before they are assembled, handle sleeves (12) are slipped over their spindles.

When the whole is assembled, the spindles meet, the ends of which engage with each other, leaving sufficient play for the handle sleeves (12) to freely rotate on said spindles.

Said handle sleeves (12) show a profile on their surface to assure a good and secure grip for the user during the various exercises.

These sleeves (12) can be formed in two parts, the inner part being rigid enough to prevent any deformations interfering with their rotation on their spindles and an outer part which carries said grip enhancing profile.

Alternatively, the rigidity of said sleeves may be gauged as to give a comfortable grip but not deform sufficiently to interfere with the rotation of said handles.

What is claimed is:

1. An exercise apparatus comprising a rigid plastic frame comprising three first parallel struts, arranged orthogonally to two second struts, one at each end of said three first struts, all five struts being arranged in one and the same plane, whereby said two second struts connect said three first struts and wherein two outer struts of the three first struts each comprises a rigid spindle and an elastic sleeve, which sleeve rotates on said spindle, such that, when in use, said sleeves serve as hand holds by means of which the apparatus is to be held and manipulated.

2. The exercise apparatus according to claim 1 wherein said rigid frame is molded in two halves from glass filled nylon or any material with similar properties.

3. The exercise apparatus according to claim 2 wherein said two outer struts are molded as part of said two halves and, upon assembly of said apparatus, each half of said two outer struts meets its opposite half to form a spindle, each of which carries one of said rotating sleeves.

4. The exercise apparatus according to claim 3 wherein a middle strut of the three first struts is formed in two halves which are, upon assembly, connected by a connecting screw which passes through said middle strut to engage with a threaded nut, thus holding the apparatus firmly together.

5. The exercise apparatus according to claim 1 wherein said elastic sleeves are molded from a thermoplastic elastomer or any material of similar properties.

6. The exercise apparatus according to claim 1 wherein said elastic sleeves have a profiled surface to ensure a secure grip for the user.

7. The exercise apparatus according to claim 1 wherein said two second struts are hollow and comprise cut-outs in their front and rear walls for weight reduction purposes.

8. The exercise apparatus according to claim 1 wherein said two second struts connect to the three first struts to form a square.

* * * * *